US009969196B2

(12) United States Patent
Mochizuki

(10) Patent No.: US 9,969,196 B2
(45) Date of Patent: May 15, 2018

(54) PRINTER APPARATUS

(71) Applicant: SATO HOLDINGS KABUSHIKI KAISHA, Tokyo (JP)

(72) Inventor: Hikari Mochizuki, Tokyo (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/311,581

(22) PCT Filed: May 18, 2015

(86) PCT No.: PCT/JP2015/064193

§ 371 (c)(1),
(2) Date: Nov. 16, 2016

(87) PCT Pub. No.: WO2015/182423

PCT Pub. Date: Dec. 3, 2015

(65) Prior Publication Data

US 2017/0087909 A1 Mar. 30, 2017

(30) Foreign Application Priority Data

May 26, 2014 (JP) ..... 2014-108070

(51) Int. Cl.
*B41J 29/13* (2006.01)
*B41J 29/38* (2006.01)
*B41J 3/407* (2006.01)

(52) U.S. Cl.
CPC ..... *B41J 29/38* (2013.01); *B41J 3/4075* (2013.01); *B41J 29/13* (2013.01)

(58) Field of Classification Search
None
See application file for complete search history.

(56) References Cited

U.S. PATENT DOCUMENTS

| | | | | |
|---|---|---|---|---|
| 7,864,300 | B2 | 1/2011 | Lee et al. | |
| 2007/0116506 | A1 | 5/2007 | Portig et al. | |
| 2010/0226683 | A1 * | 9/2010 | Yamaguchi | G03G 21/1633 399/110 |
| 2013/0156464 | A1 | 6/2013 | Suzuki et al. | |

FOREIGN PATENT DOCUMENTS

| | | | |
|---|---|---|---|
| JP | 2000-227748 | A | 8/2000 |
| JP | 2006-310518 | A | 11/2006 |
| JP | 2010-210834 | A | 9/2010 |
| JP | 4666598 | B2 * | 4/2011 |
| JP | 2013-127583 | A | 6/2013 |

OTHER PUBLICATIONS

European Search Report, dated Dec. 7, 2017, 8 pages.

* cited by examiner

*Primary Examiner* — Erica Lin
(74) *Attorney, Agent, or Firm* — Foley & Lardner LLP

(57) ABSTRACT

A printer apparatus has a main unit, a print unit, a driving unit, a control unit, and a power unit. The print unit is provided on one side surface of the main unit. The driving unit is provided on another side surface of the main unit. The control unit and the power unit are installed openably and closably to the main unit such that the driving portion, the control portion, and the power supply portion are exposable to the outside.

12 Claims, 8 Drawing Sheets

PRINTER APPARATUS

TECHNICAL FIELD

The present invention relates to a printer apparatus, and more particularly, to a printer apparatus capable of improving workability in assembly or maintenance.

BACKGROUND ART

In the prior art, there is known a printer apparatus configured to print predetermined information on a print sheet such as a label or a tag and discharge the printed sheet. In addition, a labeling machine capable of bonding a print sheet (such as a label) subjected to printing to a corrugated fiberboard or other labeling objects has been also developed (for example, see JP 4666598 B).

In such a printer apparatus, various printing types such as thermal transfer printing, (heat sensitive) color developing printing, inkjet printing, and electrostatic printing are employed. In the printer apparatus, it is required to perform inspection or maintenance works for various mechanisms or parts such as a control board or a driving gearbox.

SUMMARY OF INVENTION

However, since a lot of parts or mechanisms are assembled in a main body of the printer apparatus, the printer apparatus has a complicated internal structure.

In some cases, in order to perform maintenance, it is necessary to disassemble other unrelated parts or temporarily remove them from a main body of the printer apparatus. Therefore, there is a demand for improving workability in such cases.

For example, a gearbox or the like is blocked by a control board. For this reason, in order to replace the gearbox, it is necessary to remove a control board that does not necessitate maintenance.

In particular, if the printer apparatus is integrated into a labeling machine or the like, a conveyor or other related systems necessary to convey a labeling object to a position of the labeling machine are additionally installed. For this reason, maintainability is further degraded.

Furthermore, it is required to provide more excellent workability in a work for assembling various mechanisms and parts in the manufacturing of the printer apparatus.

In view of the aforementioned problems, it is therefore an object of the present invention to provide a printer apparatus capable of improving workability in assembly or maintenance.

That is, the present invention focuses on a printer apparatus in which various functions are unitized, and each unit is installed openably/closably.

According to the first aspect of the present invention, there is provided a printer apparatus for performing printing on a print sheet, including: a main unit: a print unit having a printing portion configured to perform printing on the print sheet; a driving unit having a driving portion configured to drive the print unit; a control unit having a control portion configured to control the driving unit and the print unit; and a power unit having a power supply portion configured to supply power to the control unit, the driving unit, and the print unit, wherein the print unit is provided on one side surface of the main unit, the driving unit is provided on another side surface of the main unit, and the control unit and the power unit are installed openably and closably to the main unit such that the driving portion, the control portion, and the power supply portion are exposable to the outside.

According to the second aspect of the present invention, the control unit may have a control unit cover openable and closable with respect to the main unit, the control portion may be provided on an inner wall surface of the control unit cover, the power unit may have a power unit cover openable and closable with respect to the main unit, and the power supply portion may be provided on an inner wall surface of the power unit cover.

According to the third aspect of the present invention, each of the control unit and the power unit may have an internal housing space for housing the driving portion, the control portion, the power supply portion, and cables for connecting the driving portion, the control portion, and the power supply portion to each other.

According to the fourth aspect of the present invention, control unit cover hinges for the control unit cover and power unit cover hinges for the power unit cover may be provided on respective opposite ends of the main unit positioned in the left and right sides of the driving unit, the driving portion and the control portion may be exposable to the outside by opening the control unit cover, and the driving portion and the power supply portion may be exposable to the outside by opening the power unit cover.

According to the fifth aspect of the present invention, a surface of the control unit cover of the control unit facing the driving unit and a surface of the control unit cover facing the power unit may be opened surfaces, and a surface of the power unit cover of the power unit facing the driving unit and a surface of the print unit cover facing the control unit may be opened surfaces.

According to the sixth aspect of the present invention, the print unit may have a print unit cover openable and closable with respect to the main unit, and the printing portion may be exposable to the outside by opening the print unit cover.

According to the seventh aspect of the present invention, the main unit may be provided with a mount portion for installing the printer apparatus in a labeling machine used to attach a label as the print sheet onto a labeling object.

According to the eighth aspect of the present invention, the mount portion may be provided on a peripheral edge of the main unit.

According to the ninth aspect of the present invention, the mount portion may include a plurality of mount holes formed on the peripheral edge of the main unit.

According to the tenth aspect of the present invention, the printer apparatus may be installed in any posture using the main unit to a labeling machine used to attach a label as the print sheet onto a labeling object.

According to the eleventh aspect of the present invention, the printer apparatus may be installed in any posture using the main unit to a labeling object where a label as the print sheet is attached.

In the printer apparatus described above, various functions of the printer apparatus are unitized, and each unit is openably and closably installed. Therefore, it is possible to access the driving portion, the control portion, and the power supply portion from the outside. Accordingly, it is possible to improve workability in assembly and maintenance.

DESCRIPTION OF EMBODIMENTS

According to an embodiment of the invention, various functions of a label printer 1 as a printer apparatus are unitized, and each unit is installed openably and closably. As a result, it is possible to achieve a printer apparatus capable of improving workability in assembly and maintenance.

The label printer 1 according to an embodiment of the invention will now be described with reference to FIGS. 1 to 8.

Figure 1:
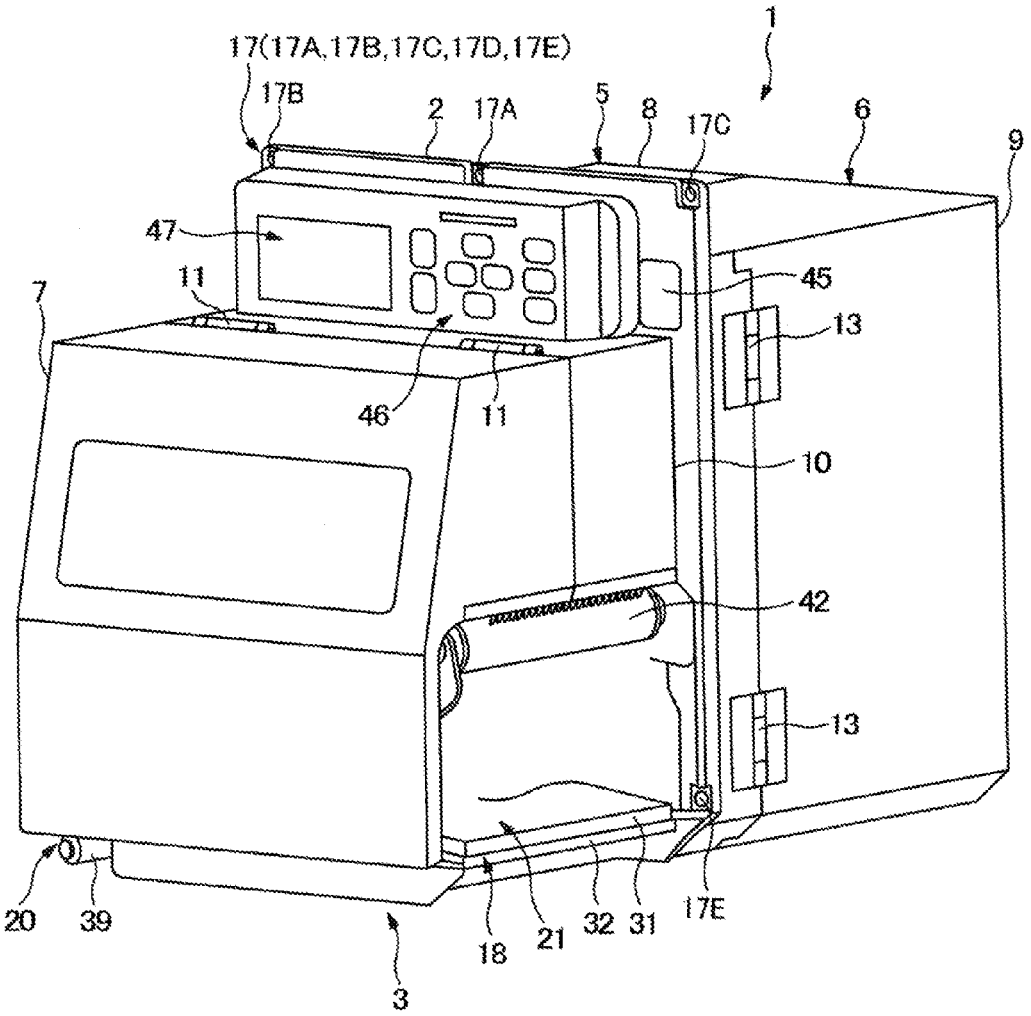
FIG. 1 is a perspective front view illustrating a label printer according to an embodiment of the invention.

FIG. 1 is a perspective front view illustrating the label printer 1.

Figure 3:
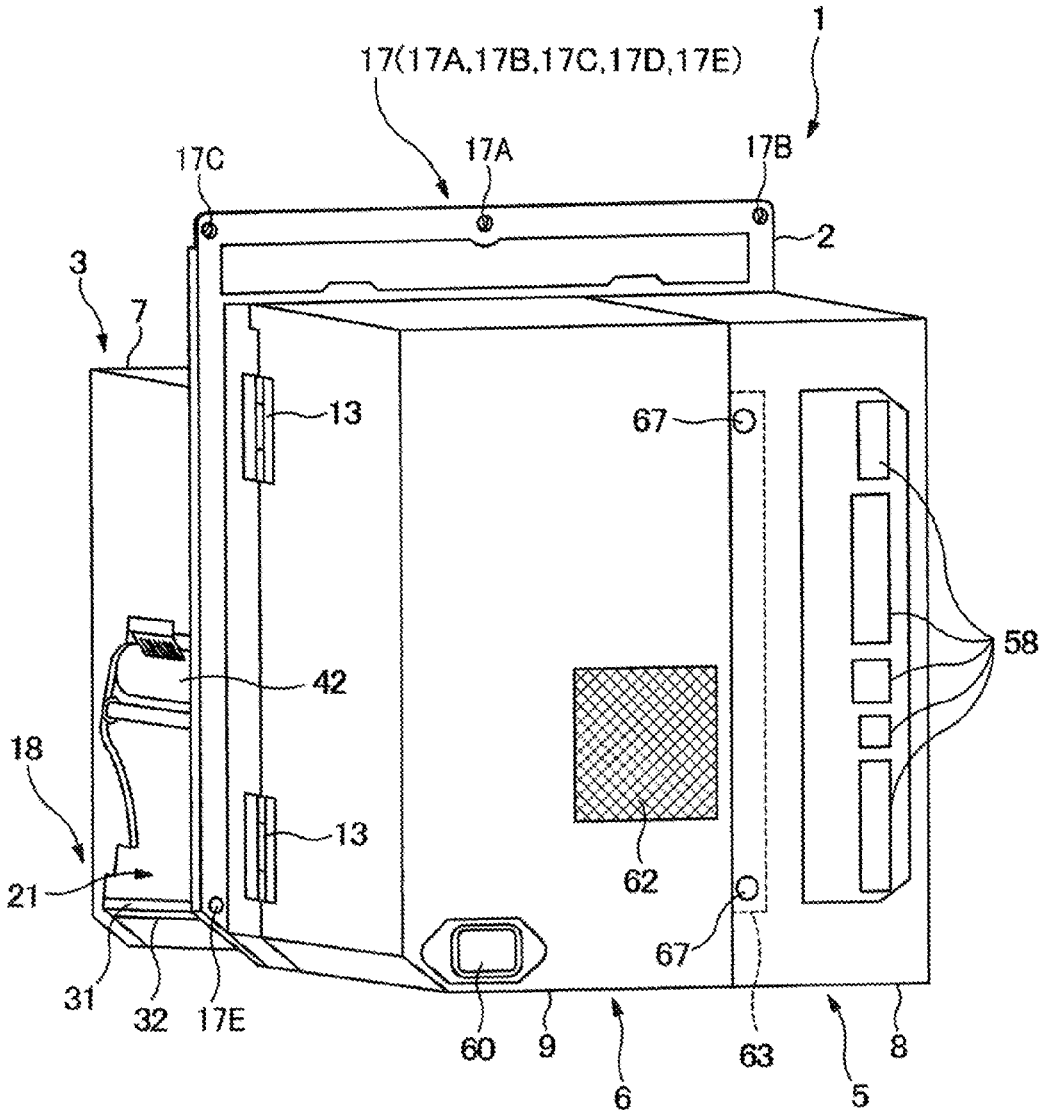
FIG. 3 is a perspective rear view illustrating a label printer.
Figure 4:
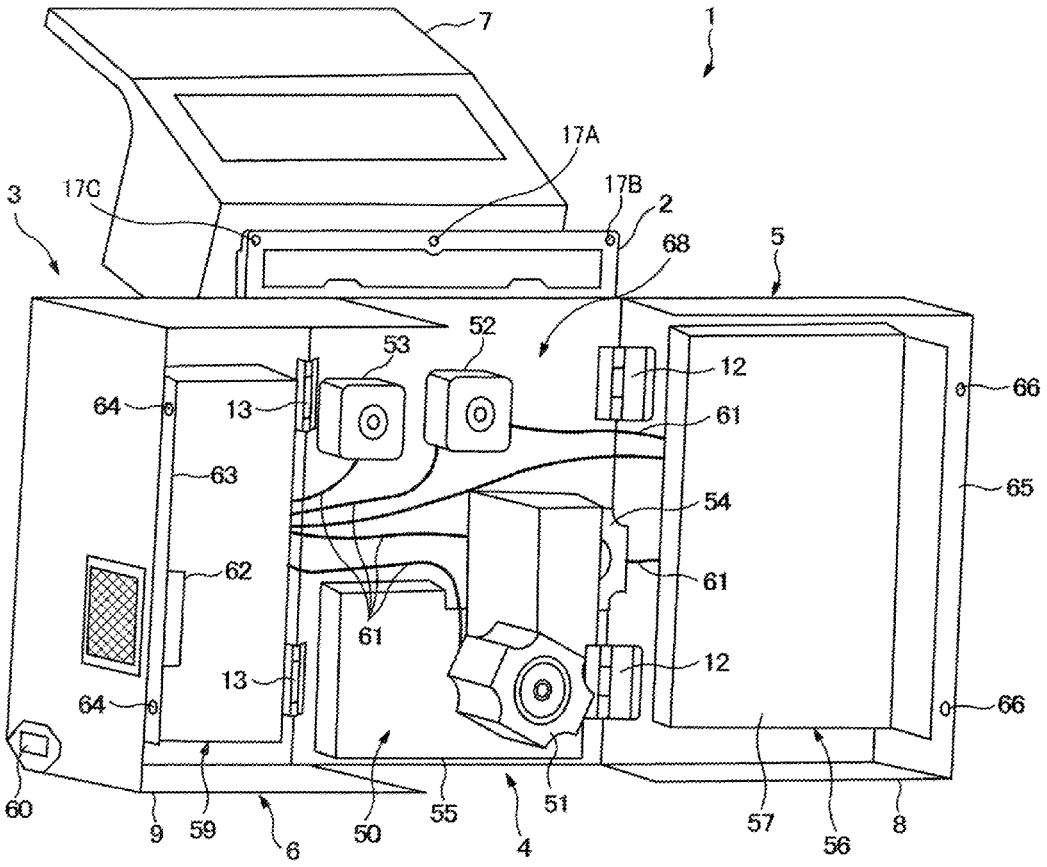
FIG. 4 is a perspective rear view illustrating the label printer when the print unit cover, the control unit cover, and the power unit cover are opened.

The label printer 1 is a printer apparatus used in a labeling machine and has a main unit 2, a print unit 3 placed on one side surface (front face) of the main unit 2, a driving unit placed on another side surface (rear face) of the main unit 2 (refer to FIG. 4), a control unit 5, and a power unit 6 (refer to FIGS. 3 and 4).

Figure 2:
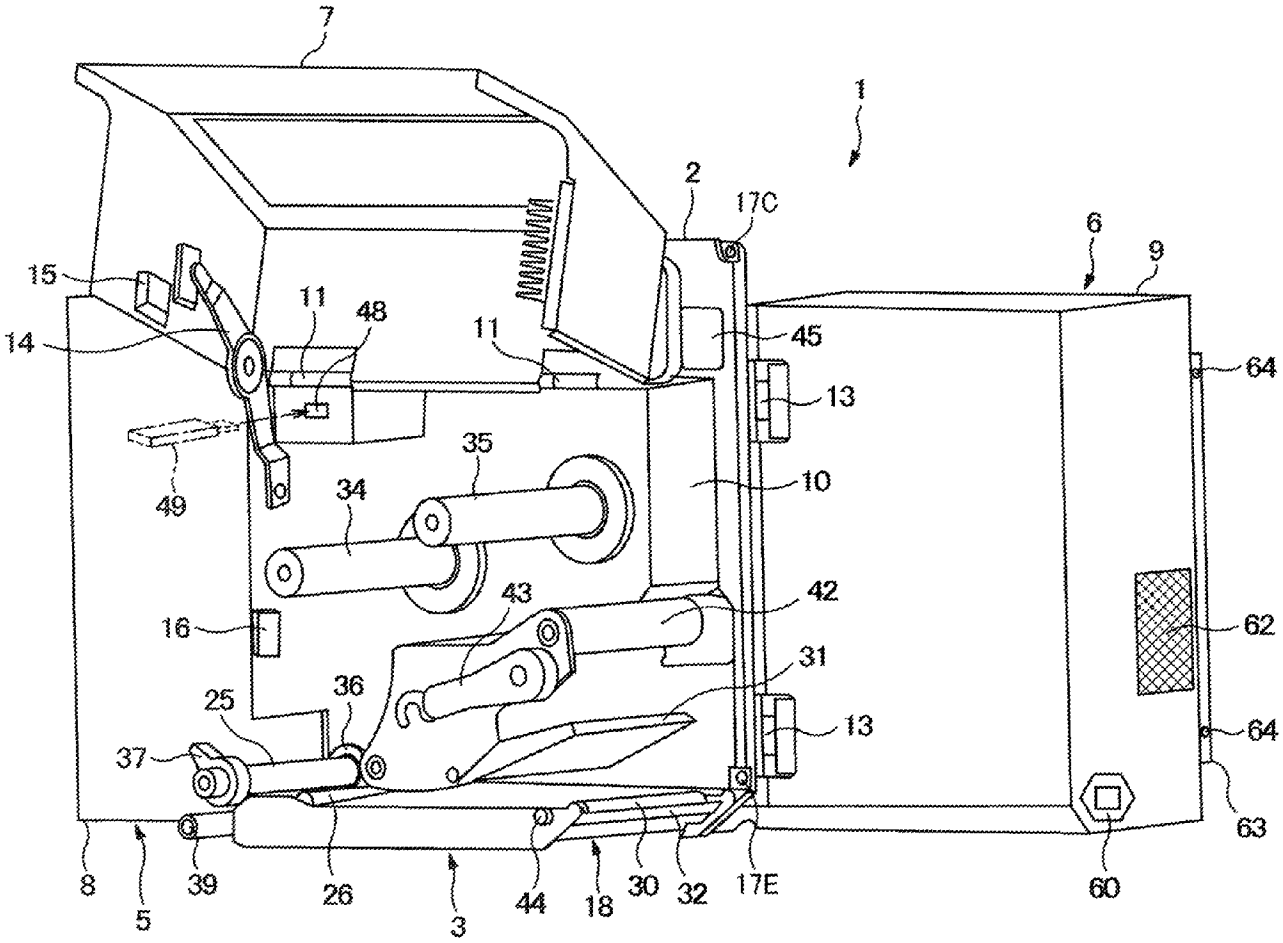
FIG. 2 is a perspective front view illustrating the label printer when a print unit cover, a control unit cover, and a power unit cover are opened.

FIG. 2 is a perspective front view illustrating the label printer 1 when a print unit cover 7 of the print unit 3, a control unit cover 8 of the control unit 5, and a power unit cover 9 of the power unit 6 are opened.

The print unit cover 7 is openable on a vertical surface around print unit cover hinges 11 provided on a support casing 10 of the main unit 2.

The control unit cover 8 is openable on a horizontal surface around control unit cover hinges 12 (refer to FIG. 4) provided on one end of the main unit 2.

The power unit cover 9 is openable on a horizontal surface around power unit cover hinges 13 provided on the other end of the main unit 2.

A support link 14 bent in synchronization with an open and close operation of the print unit cover 7 is provided between the print unit cover 7 and the support casing 10. As a result, it is possible to hold an opened state of the print unit cover 7. In addition, a pair of magnets (including a cover-side magnet 15 and a casing-side magnet 16) are provided to hold a closed state of the print unit cover 7 and open the print unit cover 7 from the closed state.

FIG. 3 is a perspective rear view illustrating the label printer 1. FIG. 4 is a perspective rear view illustrating the label printer 1 when the print unit cover 7 of the print unit 3, the control unit cover 8 of the control unit 5, and the power unit cover 9 of the power unit 6 are opened.

The main unit 2 is a rectangular panel unit having a predetermined mechanical strength and is placed in nearly a center of the label printer 1. The print unit 3, the driving unit 4, the control unit 5, and the power unit 6 are assembled in the main unit 2.

Figure 5:
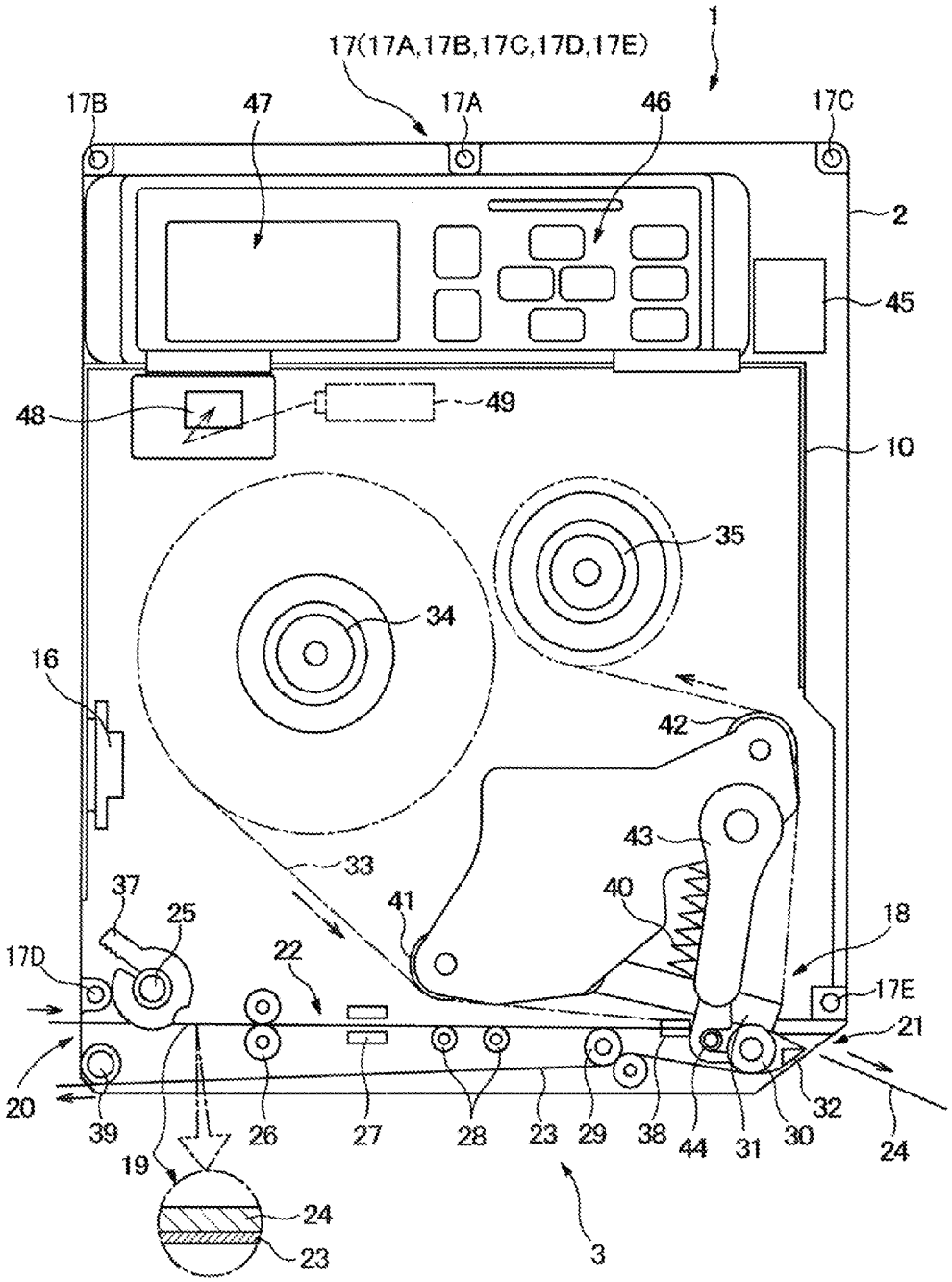
FIG. 5 is a front view illustrating the label printer when the print unit cover is removed.

FIG. 5 is a front view illustrating the label printer 1 when the print unit cover 7 of the print unit 3 is removed.

The main unit 2 is provided with a mount portion 17 for installing the label printer 1 in the labeling machine. The labeling machine will be described below in more detail.

Any configuration of the mount portion 17 may be employed. According to this embodiment, the mount portion 17 is provided on a peripheral edge of the main unit 2. More specifically, the mount portion 17 includes a plurality of (five in this embodiment) mount holes formed on the peripheral edge of the main unit 2 (including an upper center mount hole 17A, an upper left mount hole 17B, an upper right mount hole 17C, a lower left mount hole 17D, and a lower right mount hole 17E).

The print unit 3 has a printing portion 18 configured to perform printing on a print sheet (such as a label or a continuous label sheet).

As described above, the printing portion 18 of the print unit 3 are exposable to the outside (opened to access there) by opening the print unit cover 7 openably and closably installed in the main unit 2.

The print unit 3 can print predetermined information on the continuous label sheet 19 in the middle of a feeding path 22 between an inlet port 20 and an outlet port 21 of a continuous label sheet 19 (or a print sheet).

The continuous label sheet 19 has a strip shape liner sheet 23 and a plurality of label pieces 24 temporarily attached on the liner sheet 23 (refer to an enlarged cross-sectional part in FIG. 5). A position detection mark (not shown) is printed on the backside of the liner sheet 23 in advance.

The printing portion 18 has a width regulating shaft 25 (refer to FIG. 2), a pair of upper and lower subsidiary feeding rollers 26, a position detection sensor 27, a pair of guide rollers 28 arranged along a feeding direction, a liner sheet tensioning roller 29, a platen roller 30, a thermal head 31, a stripping plate 32, a ribbon feeding shaft 34 for a thermal transfer ink ribbon 33, and a ribbon roll-up shaft 35 arranged in order from the upstream side of the feeding path 22 (from the left side of FIG. 5).

The width regulating shaft 25 is provided with a first width-regulating fixing wall portion 36 arranged in the inner side in FIG. 2 (in the left side in the feeding direction of the continuous label sheet 19) and a width-regulating adjustable ring 37. In addition, a second width-regulating fixing wall portion 38 is provided near the platen roller 30 in the upstream side (refer to FIG. 5).

The first width-regulating fixing wall portion 36, the width-regulating adjustable ring 37, and the second width-regulating fixing wall portion 38 are used to regulate left and right edge positions of the continuous label sheet 19. As a result, a feeding posture of the continuous label sheet 19 is appropriately regulated along the feeding path 22.

The subsidiary feeding roller 26 is rotated in synchronization with the platen roller 30 to assist the platen roller 30 and the thermal head 31 in forward or backward feeding of the continuous label sheet 19 (in forward feeding toward the downstream side and backward feeding toward the upstream side).

The position detection sensor 27 detects a position detection mark (not shown) on the backside of the liner sheet 23. As a result, it is possible to detect a relative positional relationship between the continuous label sheet 19, the platen roller 30, and the thermal head 31.

The liner sheet tensioning roller 29 feeds the liner sheet 23 of the continuous label sheet 19 turning in a position of the stripping plate 32 backward (toward the upstream side or in the left side of FIG. 5) through the liner sheet guide roller 39. As a result, it is possible to roll up the continuous label sheet 19 around a liner sheet roll-up shaft (not shown) provided separately from the label printer 1.

The continuous label sheet 19 and the thermal transfer ink ribbon 33 are nipped between the platen roller 30 and the thermal head 31 by virtue of a predetermined print pressure applied from a pressing spring 40. Predetermined information is printed on the continuous label sheet 19 (label piece 24) by providing the thermal head 31 with print data and rotating the platen roller 30.

The thermal transfer ink ribbon 33 is fed from the ribbon feeding shaft 34 to the gap between the platen roller 30 and the thermal head 31 through a first ribbon guide roller 41 and is wound around the ribbon roll-up shaft 35 through a second ribbon guide roller 42.

As illustrated in FIG. 2, the platen roller 30 and the thermal head 31 can be released from each other by pivoting a release lever 43 clockwise. As a result, it is possible to load and nip the continuous label sheet 19 and the thermal transfer ink ribbon 33 between the platen roller 30 and the thermal head 31.

The print unit 3 can be returned to a print position (refer to FIG. 5) by pivoting the release lever 43 counterclockwise and locking a tip of the release lever 43 to a lever lock pin 44.

Figure 7:
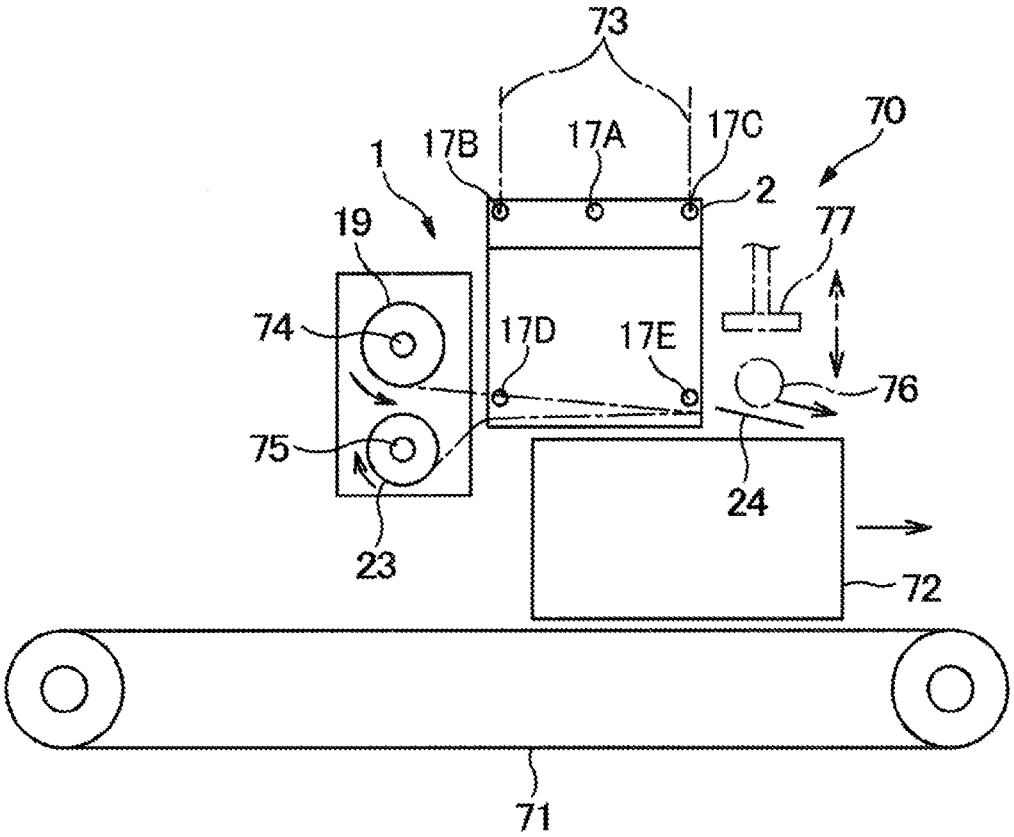
FIG. 7 is a schematic side view illustrating an exemplary labeling machine integrated with a label printer.
Figure 8:
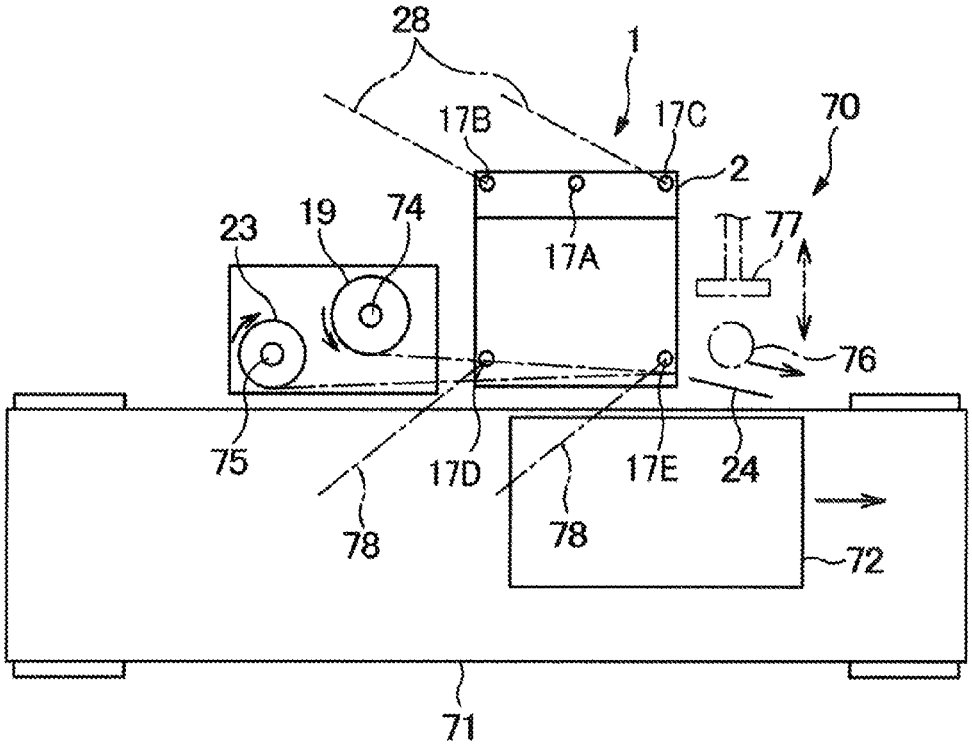
FIG. 8 is a schematic plan view illustrating another exemplary labeling machine integrated with a label printer.

The stripping plate 32 can be used to strip the label piece 24 from the liner sheet 23 by turning only the liner sheet 23 of the continuous label sheet 19 on its tip. As a result, the label piece 24 is discharged from the label printer 1. The printed label piece 24 can be attached onto a labeling object using a labeling machine described below (FIGS. 7 and 8).

Note that a control panel 46 provided with a power switch 45 and various manipulation keys and a display portion 47 such as a liquid crystal display are placed in an upper part of the support casing 10 of the main unit 2 as illustrated in FIGS. 1 and 5.

As illustrated in FIGS. 2 and 5, a universal serial bus (USB) connector 48 where a USB memory 49 can be inserted is placed on the front side of the support casing 10.

While the print unit cover 7 of the print unit 3 is closed, the USB connector 48 and the USB memory 49 are protected from the outside by the print unit cover 7. Therefore, it is possible to prevent any external impact from being directly received and avoid the USB memory 49 from being carelessly damaged or unintentionally removed. In addition, since they are not easily recognized from the outside, it is possible to prevent a theft of the USB memory 49.

The USB connector 48 is placed in an upper corner portion of the support casing 10 of the main unit 2 or in the upstream side of the feeding path 22.

Over the feeding path 22, the space of the upstream side where the ribbon feeding shaft 34 is placed is larger than the space of the downstream side where the platen roller 30 and the thermal head 31 are placed. Therefore, it is possible to effectively use space (or area) by placing the USB connector 48 in a position where the USB connector 48 does not interfere with outer circumferential surfaces corresponding to the maximum roll diameters of the thermal transfer ink ribbons 33 loaded in the ribbon feeding shaft 34 and the ribbon roll-up shaft 35, that is, an upper corner portion of the upstream side of the feeding path 22. As a result, there is no need to separately design an arrangement position of the USB connector 48. In addition, since the USB connector 48 can be arranged without affecting an outer dimension of the label printer 1, it is possible to miniaturize the label printer 1.

As illustrated in FIG. 4, the driving unit 4 is positioned oppositely to the print unit 3 of the main unit 2 and has a driving portion 50 for driving the print unit 3.

The driving portion 50 has a first driving motor 51, a second driving motor 52, a third driving motor 53, a fourth driving motor 54, and a gearbox 55. The driving motors 51 to 54 are step motors capable of exerting respective necessary driving forces.

The first driving motor 51 rotatably drives the platen roller 30, the subsidiary feeding roller 26 connected to the platen roller 30 through a timing belt (not shown), and the liner sheet tensioning roller 29.

The second driving motor 52 rotatably drives the ribbon roll-up shaft 35.

The third driving motor 53 rotatably drives the second ribbon guide roller 42.

The fourth driving motor 54 forces the thermal head 31 to be apart from the platen roller 30 upward resisting to a pressing force of the pressing spring 40 if the print data to be printed on the continuous label sheet 19 in the print unit 3 has vacancy. As a result, it is possible to suppress wasteful consumption of the thermal transfer ink ribbon 33.

The gear box 55 is connected to the first driving motor 51. As a result, it is possible to adjust a rotation pitch of the platen roller 30 depending on a print intensity on the continuous label sheet 19 in the print unit 3.

The control unit 5 has a control portion 56 that performs control for the driving unit 4, the print unit 3, and the power unit 6. In addition, the control unit 5 has a control unit cover 8 openably and closably installed in the main unit 2. The control portion 56 is provided on an inner wall surface of the control unit cover 8.

The control portion 56 has a control board 57. Various electric connectors 58 (FIG. 3) are provided on the front face side of the control unit cover 8 so that communication of data and commands are allowed between the control portion 56 and other external devices such as a personal computer (not shown).

The power unit 6 has a power supply portion 59 that supplies power to the control unit 5, the driving unit 4, and the print unit 3. The power unit 6 has a power unit cover 9 openably and closably installed in the main unit 2. The power supply portion 59 is provided on an inner wall surface of the power unit cover 9.

The power supply portion 59 receives external power through an electric outlet 60 and supplies necessary power to the print unit 3, the driving unit 4, the control unit 5, and the control panel 46, the display portion 47, and the like through various cables 61. Note that various cables 61 are just schematically illustrated in FIG. 4.

The power unit cover 9 is provided with a ventilating fan 62. As a result, the inner space (housing space 68) for the driving unit 4, the control unit 5, and the power unit 6 are ventilated when their covers are closed. The housing space 68 will be described below in detail.

As illustrated in FIG. 4, a narrow lock plate 63 is integratedly provided on an open end edge of the power unit cover 9. The lock plate 63 is provided with a pair of fixing screw holes 64.

Furthermore, a pair of fixing screw holes 66 are formed on a narrow open end edge 65 of the control unit cover 8.

Therefore, as illustrated in FIG. 3, the power unit cover 9 is locked to the control unit cover 8 such that the lock plate 63 is placed inside the open end edge 65. In this state, a pair of holding screws 67 are inserted in the fixing screw holes 64 and 66, so that the power unit cover 9 and the control unit cover 8 can be maintained in a closed state.

As illustrated in FIG. 4, the control unit cover 8 has a rectangular shape. In the control unit cover 8, a surface facing the driving unit 4 and a surface facing the power unit 6 are opened surfaces. Similarly, the power unit cover 9 has a rectangular shape. In the power unit cover 9, a surface facing the driving unit 4 and a surface facing the control unit 5 are opened surfaces.

The control unit cover hinges 12 of the control unit cover 8 and the power unit cover hinges 13 of the power unit cover 9 are provided on respective opposite ends of the main unit 2 with respect to the driving unit 4. That is, each of the control unit 5 and the power unit 6 is openably and closably installed in the main unit 2.

Therefore, the driving portion 50 and the control portion 56 are exposable to the outside by opening the control unit cover 8. In addition, the driving portion 50 and the power supply portion 59 are exposable to the outside by opening the power unit cover 9.

As a result, when all of the driving unit 4, the control unit 5, and the power unit 6 are exposed to the outside by opening the control unit cover 8 of the control unit 5 and the power unit cover 9 of the power unit 6, it is possible to easily perform maintenance for the driving portion 50, the control portion 56, and the power supply portion 59.

In other words, in the label printer 1, it is possible to form the housing space 68 for housing the driving portion 50, the control portion 56, and the power supply portion 59 inside the control unit 5 and the power unit 6. In addition, various cables 61 for connecting the driving portion 50, the control portion 56, and the power supply portion 59 to each other can be housed inside the housing space 68.

Figure 6A:
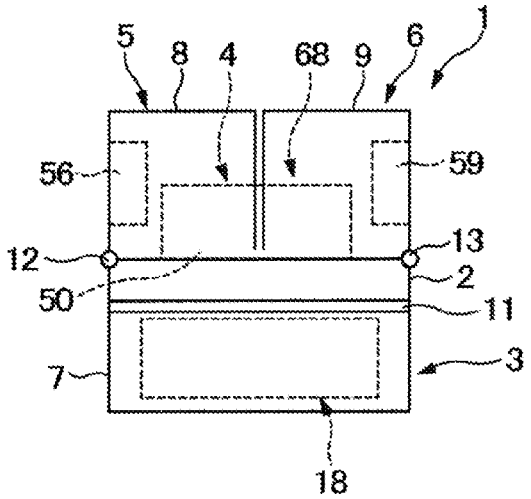
FIG. 6A is a schematic plan view illustrating a configuration of the label printer.
Figure 6B:
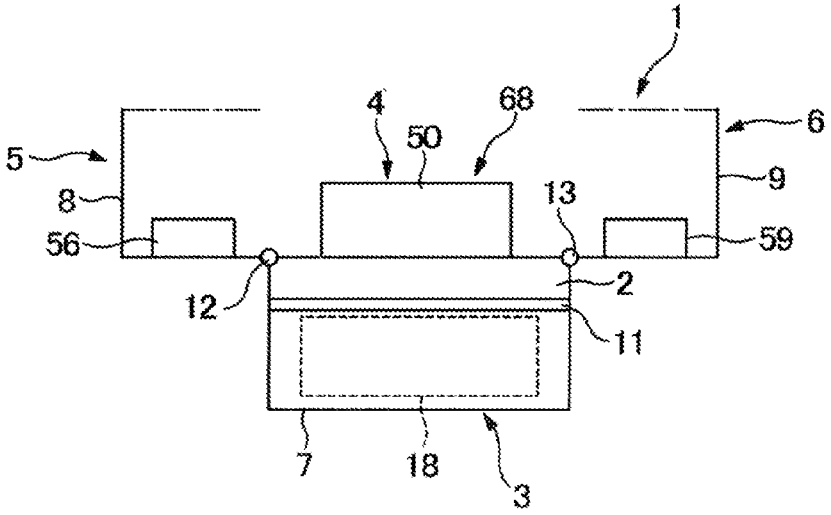
FIG. 6B is a schematic plan view illustrating the label printer when the control unit cover and the power unit cover are opened.
Figure 6C:
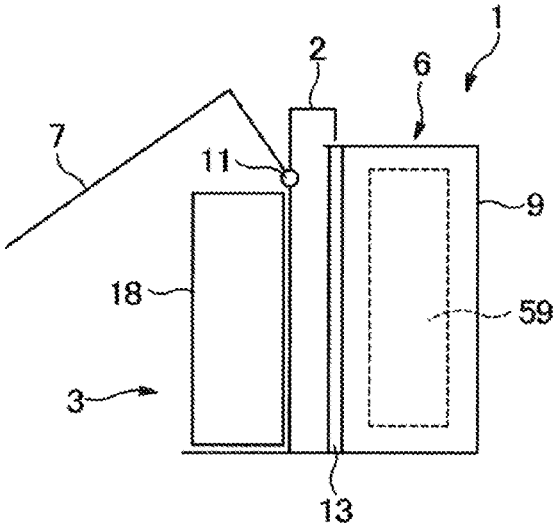
FIG. 6C is a schematic side view illustrating the label printer when the print unit cover is opened.

FIG. 6A is a schematic plan view illustrating a configuration of the label printer 1. FIG. 6B is a schematic plan view illustrating the label printer 1 when the control unit cover 8 of the control unit 5 and the power unit cover 9 of the power unit 6 are opened. FIG. 6C is a schematic side view illustrating the label printer 1 when the print unit cover 7 of the print unit 3 is opened.

As illustrated in FIG. 6A, in the label printer 1, the print unit 3 is provided on one side surface of the main unit 2, and the driving unit 4 is provided on the other side surface of the main unit 2 as described above, so that the control unit 5 and the power unit 6 are openably and closably installed in the main unit 2. As a result, the driving portion 50, the control portion 56, and the power supply portion 59 are exposable to the outside.

As illustrated in FIG. 6B, the control portion 56 and the driving portion 50 are exposable to the outside when the control unit cover 8 is opened by pivoting the control unit cover 8 around the control unit cover hinges 12. In addition, the power supply portion 59 and the driving portion 50 are exposable to the outside when the power unit cover 9 is opened by pivoting the power unit cover 9 around the power unit cover hinges 13.

As illustrated in FIG. 6C, the printing portion 18 is exposable to the outside when the print unit cover 7 is opened by pivoting the print unit cover 7 around the print unit cover hinges 11.

Therefore, the continuous label sheet 19 and the thermal transfer ink ribbon 33 can be loaded on the printing portion 18 while the print unit cover 7 is opened. In addition, it is possible to perform maintenance for the printing portion 18 as necessary.

In addition, it is possible to perform maintenance for the driving portion 50 and the control portion 56 as necessary by opening the control unit cover 8.

Furthermore, it is possible to perform maintenance for the driving portion 50 and the power supply portion 59 as necessary by opening the power unit cover 9.

That is, if the control unit cover 8 and the power unit cover 9 are opened through pivoting, it is possible to expose the driving portion 50, the control portion 56, and the power supply portion 59 to the outside on the same plane (vertical surface in FIGS. 6A and 6B). As a result, it is possible to easily and immediately access necessary parts of each mechanism or component and perform maintenance as necessary.

In addition, it is possible to improve workability in assembly of the driving portion 50, the control portion 56, and the power supply portion 59 in a manufacturing process of the label printer 1.

In addition, it is possible to simplify and easily handle an internal structure of the label printer 1.

In addition, it is possible to expose internal mechanisms of the label printer 1 to the outside through simple manipulation (improved accessibility).

The label printer 1 can be installed in any posture to the labeling machine using the main unit 2.

In addition, the label printer 1 can be installed in any posture to the labeling object using the main unit 2.

For example, FIG. 7 is a schematic side view illustrating an exemplary labeling machine 70 integrated with the label printer 1.

In this example, the label printer 1 of the labeling machine 70 is placed over a labeling object 72 (such as a corrugated fiberboard box) conveyed on a conveyor 71.

The labeling machine 70 is suspended in the air using vertical support arms 73 installed in the upper left mount hole 17B and the upper right mount hole 17C of the mount portion 17 of the label printer 1 while the label printer 1 is vertically erected.

The labeling machine 70 has a feeder 74 for feeding the continuous label sheet 19 to the label printer 1 and a liner sheet roll-up portion 75.

As a result, necessary information is printed on the continuous label sheet 19 (label piece 24) using the printing portion 18 (refer to FIG. 5), and the printed label piece 24 is discharged to an upper side of the labeling object 72. Then, the label piece 24 can be attached onto the upper surface of the labeling object 72 using a labeling roller 76 or a labeling suction device 77 of the labeling machine 70.

FIG. 8 is a schematic plan view illustrating another exemplary labeling machine 70 integrated with the label printer 1.

In this example, the label printer 1 of the labeling machine 70 is provided beside the labeling object 72 conveyed on the conveyor 71.

The labeling machine 70 is suspended in the air using lateral support arms 78 installed in the upper left mount hole 17B, the upper right mount hole 17C, the lower left mount hole 17D, and the lower right mount hole 17E of the mount portion 17 of the label printer 1 while the label printer 1 lies sideways on a horizontal plane. Typically, the lateral support arms 78 are installed vertically with respect to the paper plane of FIG. 8. However, in FIG. 8, the lateral support arms 78 are plotted as inclined virtual lines for easy understanding.

As a result, the printing portion 18 (refer to FIG. 5) performs printing on the continuous label sheet 19 (label piece 24), and the label piece 24 is discharged to the lateral side of the labeling object 72 while the label piece 24 is vertically erected. Then, the printed label piece 24 can be attached onto the side surface of the labeling object 72 using the labeling roller 76 or the labeling suction device 77.

Although embodiments of this invention have been described hereinbefore, the aforementioned embodiments are just a part of applications of this invention, and are not intended to limit the technical scope of this invention to specific configurations of the aforementioned embodiments.

For example, in the embodiment described above, the label printer 1 as a printer apparatus is integrated into the labeling machine 70. Alternatively, the printer apparatus may be operated independently or may be integrated into any other mechanism or system.

In addition, in addition to the continuous label sheet 19 glued with the liner sheet 23, any other print sheet such as a label having no liner sheet or a tag sheet having no adhesive surface may also be employed. In addition, the printing portion may be differently designed depending on each print sheet type.

This application is based on and claims priority to Japanese Patent Application Laid-open No. 2014-108070 (filed in Japan Patent Office on May 26, 2014), the entire content of which is incorporated herein by reference.

The invention claimed is:

1. A printer apparatus for performing printing on a print sheet, comprising:

a main unit;

a print unit provided on a first side surface of the main unit, the print unit having a printing portion configured to perform printing on the print sheet;

a driving unit provided on a second side surface of the main unit, the driving unit having a driving portion configured to drive the print unit;

a control unit cover configured to open and close, the control unit cover being installed to one side of the second side surface of the main unit;

a control unit having a control portion configured to control the driving unit and the print unit, the control unit being provided on the control unit cover;

a power unit cover configured to open and close, the power unit cover being installed to another side of the second side surface of the main unit; and a power unit having a power supply portion configured to supply power to the control unit, the driving unit, and the print unit, the power unit being provided on the power unit cover.

2. The printer apparatus according to claim 1, wherein the control portion is provided on an inner wall surface of the control unit cover, and the power supply portion is provided on an inner wall surface of the power unit cover.

3. The printer apparatus according to claim 1, wherein each of the control unit and the power unit has an internal housing space configured to house the driving portion, the control portion, the power supply portion, and cables for connecting the driving portion, the control portion, and the power supply portion to each other.

4. The printer apparatus according to claim 1, further comprising control unit cover hinges for the control unit cover and power unit cover hinges for the power unit cover, the control unit cover hinges and the power unit cover hinges being provided in respective opposite ends of the main unit positioned on the left and right sides of the driving unit, wherein the driving portion and the control portion are configured to be exposed to an outside by opening the control unit cover, and the driving portion and the power supply portion are configured to be exposed to the outside by opening the power unit cover.

5. The printer apparatus according to claim 1, wherein a surface of the control unit cover that faces the driving unit and a surface of the control unit cover that faces the power unit are opened surfaces, and a surface of the power unit cover that faces the driving unit and a surface of the print unit cover that faces the control unit are opened surfaces.

6. The printer apparatus according to claim 1, further comprising a print unit cover configured to open and close with respect to the main unit, wherein the printing portion is configured to be exposed to an outside by opening the print unit cover.

7. The printer apparatus according to claim 1, wherein the main unit is provided with a mount portion for installing the printer apparatus in a labeling machine used to attach a label as the print sheet onto a labeling object.

8. The printer apparatus according to claim 7, wherein the mount portion is provided on a peripheral edge of the main unit.

9. The printer apparatus according to claim 7, wherein the mount portion includes a plurality of mount holes formed on a peripheral edge of the main unit.

10. The printer apparatus according to claim 2, wherein the driving portion, the control portion, and the power supply portion are accessible from the second side surface of the main unit when the control unit cover and the power unit cover are in an open state.

11. The printer apparatus according to claim 1, wherein the driving unit is provided in an interior defined at least in part by the power unit cover in a closed state and the control unit cover in a closed state, and the power unit cover and the control unit cover are configured to open in a direction to separate from each other such that the driving unit, the control unit, and the power supply portion are exposed to an outside of the printer apparatus.

12. The printer apparatus according to claim 6, wherein the print unit cover is installed to the first side surface of the main unit.

* * * * *